US007921776B2

(12) United States Patent
Walsh et al.

(10) Patent No.: US 7,921,776 B2
(45) Date of Patent: Apr. 12, 2011

(54) DETONATING CORD WITH PROTECTIVE JACKET

(75) Inventors: Brendan M. Walsh, Simsbury, CT (US); P. Cary Franklin, Madisonville, KY (US)

(73) Assignee: Ensign-Bickford Aerospace & Defense Company, Simsbury, CT (US)

( * ) Notice: Subject to any disclaimer, the term of this patent is extended or adjusted under 35 U.S.C. 154(b) by 891 days.

(21) Appl. No.: 11/569,365

(22) PCT Filed: Jun. 1, 2004

(86) PCT No.: PCT/US2004/017354
§ 371 (c)(1),
(2), (4) Date: Aug. 1, 2007

(87) PCT Pub. No.: WO2005/119167
PCT Pub. Date: Dec. 15, 2005

(65) Prior Publication Data

US 2008/0028970 A1 Feb. 7, 2008

(51) Int. Cl.
*C06C 5/04* (2006.01)

(52) U.S. Cl. ..... 102/275.8; 102/202.5; 102/275.5

(58) Field of Classification Search ..... 102/275.8, 102/202.5, 275.5
See application file for complete search history.

(56) References Cited

U.S. PATENT DOCUMENTS 2,113,004 A 4/1938 Snelling
2,445,032 A * 7/1948 Mcfariand ..... 102/275.8
2,877,708 A * 3/1959 Rey ..... 102/275.8
2,891,475 A 6/1959 Dolan et al.
2,982,210 A 5/1961 Andrew et al.
3,311,056 A 3/1967 Noddin
3,382,802 A 5/1968 Prior et al.
3,590,739 A 7/1971 Persson
3,726,216 A 4/1973 Calder, Jr. et al.
3,990,367 A * 11/1976 Smith ..... 102/275.4
4,024,817 A 5/1977 Calder, Jr. et al.
4,083,305 A 4/1978 Garrison et al.
4,178,853 A 12/1979 Garrison et al.
(Continued)

OTHER PUBLICATIONS

International Search Report and Written Opinion for PCT/US04/17354, mailed Apr. 24, 2006, 6 pages.

*Primary Examiner* — Troy Chambers
(74) *Attorney, Agent, or Firm* — Cantor Colburn LLP

(57) ABSTRACT

This invention relates to a detonating cord (10) having a core (12) of reactive material and a composite jacket around the core, and the method of its manufacture. The composite jacket includes an interior jacket (14) in contact with the core and a sacrificial jacket (20) disposed over the interior jacket. The sacrificial jacket prevents the cord from being cut off by the detonation of another detonating cord of like core load disposed adjacent thereto. The sacrificial jacket is separable from the interior jacket beneath it under the force of the adjacent detonating cord, thus absorbing energy and allowing the first detonating cord to remain intact. The detonating cord may have a core load of not more than 3.2 grams/meter (15 grains/ft) or, optionally, less than 1.25 g/m (6 grains/ft). The interior jacket may be free of metal jacket layers. Optionally, the outer cross-sectional diameter of the cord may be not more than about 3.8 mm (0.15 inch) so that it can be inserted into a standard detonator. The sacrificial jacket may be made from polyethylene and may have a thickness of about 0.25 mm (0.01 inch).

15 Claims, 5 Drawing Sheets

U.S. PATENT DOCUMENTS 4,493,261 A 1/1985 Simon et al.
4,607,573 A * 8/1986 Thureson et al. ..... 102/275.8
4,699,059 A 10/1987 Kelly et al.
4,991,511 A 2/1991 Simpson
5,223,664 A 6/1993 Rogers
5,597,973 A * 1/1997 Gladden et al. ..... 102/289
5,827,994 A 10/1998 Gladden et al.

* cited by examiner

DETONATING CORD WITH PROTECTIVE JACKET

BACKGROUND OF THE INVENTION

1. Field of the Invention

The present invention relates to detonating cord and, in particular, to low-energy detonating cord that is not subject to cut-off by a similar detonating cord that functions when in contact therewith.

Detonating cord is well-known in the art of initiating explosive signals and usually comprises a solid core of explosive material such as pentaerythritol tetranitrate (hereinafter "PETN") enclosed within a single- or multilayer-jacket. Some detonating cords comprise a single layer jacket, e.g., a single layer of polyethylene extruded over the explosive core, but typically, the jacket comprises a textile tube in direct contact with the core of explosive materials and one or more additional jacket layers thereover to provide the desired tensile strength, resistance to deactivation by water, and other desired characteristics. Detonating cord has a variety of uses, including the transmission of a detonation signal along its length from one device to another. Frequently, on a blasting site, one length of detonating cord may come in contact with another, either inadvertently or by design. Such inadvertent contact may occur with one section of a length of detonating cord with another section of the same cord; at other times it occurs because one cord must cross over another in order to convey detonation signals to their respective destinations. Some detonating cords come into contact by design, e.g., by the tying of a knot between them, so that a signal on one cord can be transferred to another cord.

A common problem with the use of detonating cord in these ways is that, depending on the nature of the contact between them, a first functioning detonating cord (or section thereof) may "cut off" another length of detonating cord, i.e., it may sever the second length of cord without initiating a signal therein. Once severed, the detonating cord is incapable of functioning to convey a detonation signal to its intended target. Cut-off may occur when one length of detonating cord is disposed in close proximity, or in contact, with another in a manner that does not permit signal transfer from one cord (or section thereof) to another. As indicated above, tying a knot between two cords is typically sufficient to enable signal transfer from one cord to another, but often, disposing the cords in unknotted, side-by-side relation with each other, or at an acute angle relative to one another, will cause the output from one cord to sever, but not initiate, the other.

2. Related Art

U.S. Pat. No. 3,726,216, issued to Calder, Jr. et al on Apr. 10, 1973, and entitled "Detonation Device and Method For Making the Same", discloses a detonating cord designed for signal transfer from one section of such cord to another by tying a knot between them. The occurrence of cut-off is reduced so that the cords need not be restricted to mutually perpendicular orientation. This is achieved through the use of core material having finely granulated particles. In the illustrated embodiment, the explosive core is surrounded by several jacket layers, including (from inward to outward) an inner layer of fibrous layer 54, a textile layer 56, another textile layer 58, a moisture-impervious barrier 60, a textile layer 62, another textile layer 64 and a water-repellant outer protective layer 66. The PETN core material has a fine granulation such that only 15 percent or less by weigh is retained on a 100 mesh sieve (column 5, lines 27-33). The core loading of such material is in the range of about 15 to 40 grains per foot (column 5, lines 37-40 and column 8, lines 43-48).

U.S. Pat. No. 3,311,056, issued to Noddin on Mar. 28, 1967, and entitled "Non-Rupturing Detonating Cords", discloses a detonating cord comprising an explosive core encased within a polyurethane elastomer sheath. The polyurethane sheath may be in direct contact with the core or it may be separated therefrom by one or more layers of materials such as metal, plastic or fabric (see column 2, lines 46-52). The core loading may be from 1 to 400 grains per foot (column 3, lines 8-11). The polyurethane does not rupture when the cord functions, so the cord will not affect adjacent temperature-sensitive materials (column 3, lines 55-65).

U.S. Pat. No. 2,982,210, issued to Andrew et al on May 2, 1961, and entitled "Connecting Cord", discloses a cord comprising a crystalline cap-sensitive high explosive core 1 enclosed within a metal sheath 2 at a loading of 0.1 to 2 grains per foot. The metal sheath 2 may or may not be covered by a non-metallic material 3 such as fabric or plastic (see column 2, lines 48-60). The cord will not initiate or damage another cord adjacent to it, or an adjacent dynamite cartridge; it can be tied in knots without interfering in the propagation of the detonation pulse and without a cut-off at the knot (see column 3, lines 35-40), and it can be used for bottom-hole priming (see column 5, lines 29-35).

U.S. Pat. No. 4,024,817, issued to Calder, Jr. et al on May 24, 1977, and entitled "Elongated Flexible Detonating Device", discloses a detonating cord 20 having an outer energy-absorbing layer 30 releasably applied thereto (see column 9, lines 32-35). The energy-absorbing layer, which may comprise extruded plastic 72, is separated from the detonating cord therein by an intervening layer of fibrous material 70 such as cotton, rayon or other yarn (see column 9, lines 59-65). Therefore, the energy-absorbing layer 30 can be stripped from the detonating cord therein (see column 4, line 67 through column 5, line 3). The energy-absorbing layer and the layer of fibrous material 70 serve to dampen and reduce the transmitted energy available when the detonating cord is initiated, to prevent the detonation of explosive material which is in contact with the energy-absorbing layer 30 (see column 4, lines 24-28, lines 46-50 and column 5, lines 6-15). A short length of the energy-absorbing layer can be removed from the end of the detonating cord by circumferentially cutting the layer and slipping the severed portion of energy-absorbing layer off the end of the detonating cord (see column 10, lines 31-36).

SUMMARY OF THE INVENTION

This invention relates to a detonating cord comprising a core of reactive material and a composite jacket around the core. The composite jacket comprises an interior jacket surrounding the core and in contact therewith, and comprising an outermost interior jacket layer and a sacrificial jacket disposed over the interior jacket, the sacrificial jacket being separable from the interior jacket in response to the detonation of an adjacent similar section of detonating cord and being effective to prevent the cord from being cut off by the adjacent similar section of detonating cord.

According to one aspect of the invention, the detonating cord may have a core load of less than about 3.2 grams/meter (g/m) (15 grains per foot (grains/ft)) or, optionally, less than 1.25 g/m (6 grains/ft). Alternatively, the detonating cord may have a core load in the range of about 0.2 to 2 g/m (1 to 10 grains/ft) or, optionally, in the range of from about 1 to 1.5 g/m (5 to 7 grains/ft).

According to another aspect of the invention, the outer cross-sectional diameter of the cord may be not greater than about 3.8 millimeter (mm) (0.15 inch).

According to still another aspect of the invention, the interior jacket may be free of metal jacket layers.

According to still another aspect of the invention, the sacrificial jacket may comprise a sacrificial textile layer woven over the interior jacket and a sacrificial extruded layer extruded over the sacrificial textile layer. Optionally, the sacrificial extruded layer may comprise a layer of polyethylene having a thickness of about 0.25 mm (0.01 inch).

In other embodiments of the invention, the sacrificial jacket may comprise a sacrificial extruded layer disposed directly onto the interior jacket. Optionally, the outermost interior jacket layer and the sacrificial jacket may comprise mutually compatible polymeric materials. For example, the sacrificial extruded layer and the outermost interior jacket layer may both comprise polyethylene and the thickness of the sacrificial extruded layer has a thickness of about 0.01 inch. Alternatively, the outermost interior jacket layer and the sacrificial jacket may comprise mutually incompatible polymeric materials.

This invention also relates to a method for making a detonating cord, comprising disposing an interior jacket around a core of explosive material, the interior jacket comprising at least an outermost interior jacket layer, the interior jacket being insufficient to protect the detonating, cord against cut-off by the initiation of an adjacent similar section of detonating cord, and disposing a sacrificial jacket over the interior jacket.

The method may comprise extruding the sacrificial jacket onto the interior jacket, wherein the sacrificial jacket and the outermost interior jacket layer comprise polymeric materials that are mutually compatible, and cooling the interior jacket before extruding the sacrificial jacket onto it.

Optionally, the method may comprise extruding the sacrificial jacket onto the interior jacket, wherein the sacrificial jacket and the outermost interior jacket layer comprise mutually incompatible polymeric materials.

In one embodiment, disposing the sacrificial jacket around the interior jacket may comprise forming a sacrificial textile layer over the interior jacket and extruding a sacrificial extruded layer onto the sacrificial textile layer.

DETAILED DESCRIPTION OF THE INVENTION AND PREFERRED EMBODIMENTS THEREOF

Figure 1:
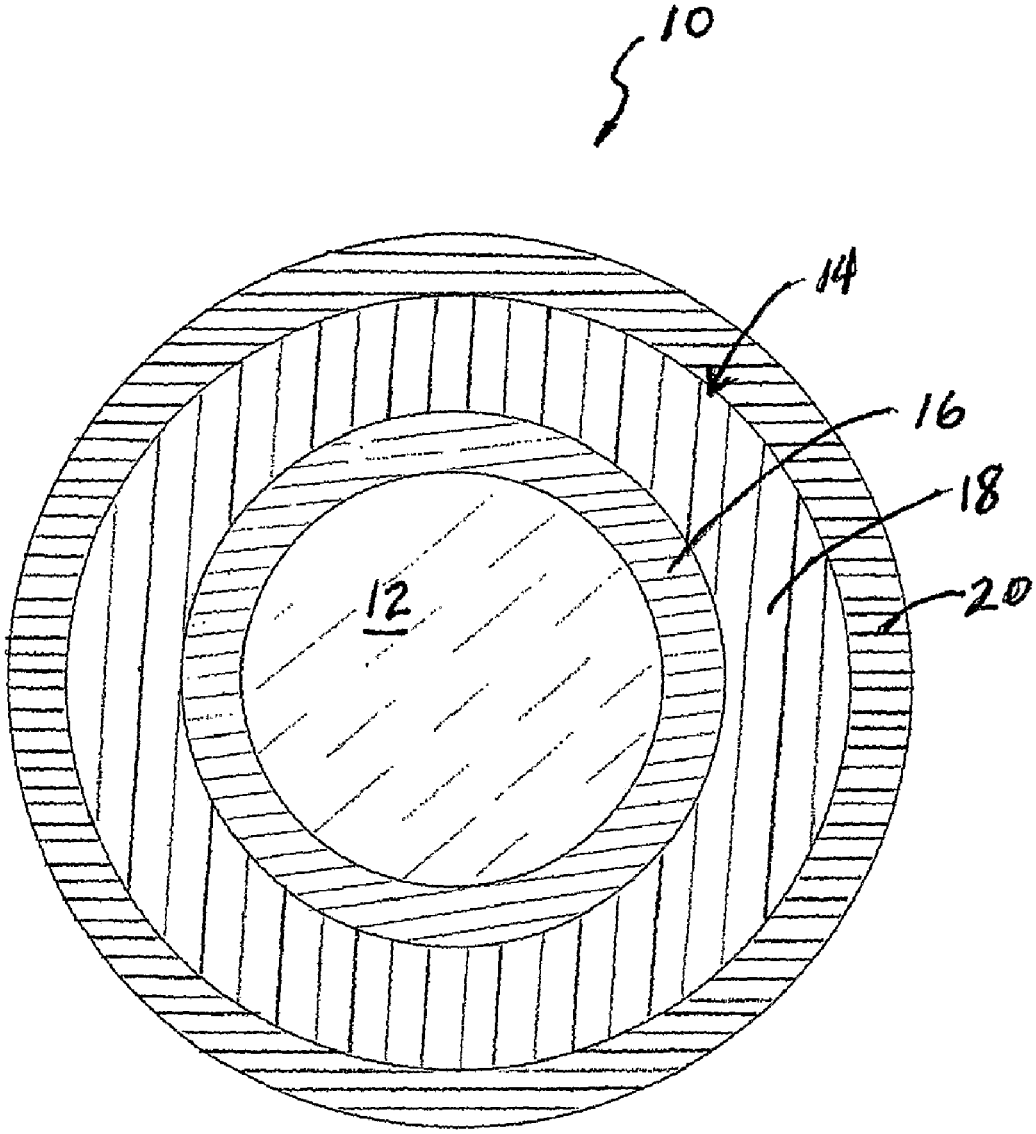
FIG. 1 is a schematic, cross-sectional view of a detonating cord according to one particular embodiment of the present invention.

Detonating cords described herein comprise an outer sacrificial jacket which has the protective ability to prevent cut-off due to the initiation of another length of detonating cord of the same or similar core loading in contact therewith. Such a detonating cord can be used under conditions in which a section of the cord comes in contact with a similar section of detonating cord (i.e., another section of the same cord or a section of detonating cord having a like core load of explosive material) without experiencing cut-off at the point of contact. This is achieved without the need to provide a jacket that completely contains the explosive output of the core of the detonating cord. Thus, the detonating cord exhibits some degree of brisance and may, in fact, cause cut-off of a length of detonating cord not configured in accordance with this invention. Various embodiments of detonating cord described herein can be made without a metal jacket layer in the interior jacket or in the sacrificial jacket, i.e., the cord may comprise a composite jacket that is substantially free of any metal layer.

In addition, some embodiments of a detonating cord as described herein meet a cross-sectional outside diameter constraint that enables the cord to be capped, i.e., inserted into the shell of a standard-sized detonator having an inside diameter of about 1.3 mm (about 0.5 inch), without the need to strip any part of the jacket of the detonating cord before inserting it into the shell.

The subject detonating cords comprise a core of explosive material surrounded by a composite jacket having two components: an interior jacket and an outer sacrificial jacket, both of which comprise one or more jacket layers. The outermost layer (relative to the core) of the interior jacket is in contact with the sacrificial jacket, which is disposed thereon. Upon exposure to the brisance of an adjacent similar section of detonating cord, the sacrificial jacket is broken and peeled away from the interior jacket beneath it, but at least part of the interior jacket and explosive core of the detonating cord remain intact, without having suffered cut-off, leaving the cord functional. In some embodiments, the sacrificial jacket comprises a sacrificial extruded layer comprising extruded polymeric material, which may be in direct contact with the interior jacket, or the sacrificial jacket may optionally further comprise additional sacrificial layers, such as a sacrificial textile layer, within the sacrificial extruded layer and in contact with the interior jacket. Without wishing to be bound by any particular theory, it is believed that the fracture and peeling of the sacrificial jacket absorbs and diverts sufficient energy from the adjacent functioning detonating cord to preserve the integrity of the explosive core and interior jacket therein, so that cut-off is avoided and the utility of the remaining detonating cord is preserved.

To allow the sacrificial jacket to peel away from the interior jacket, the sacrificial jacket is not tightly bound to the interior jacket, i.e., the sacrificial jacket must be relatively easily separable from the adjacent outermost interior jacket layer. The sacrificial jacket can be rendered separable from the interior jacket by several methods. When the sacrificial jacket comprises a sacrificial extruded layer extruded directly onto the interior jacket, adhesion between the two jackets can be minimized to make the sacrificial jacket separable from the interior jacket by cooling the outermost layer of the interior jacket before extruding the sacrificial jacket over it. Cooling can be achieved, in one embodiment, by passing the interior jacket through a cooling bath before extruding the sacrificial extruded layer onto it. This procedure facilitates the use of a sacrificial extruded layer that comprises a material that is compatible with the material of the outermost interior jacket layer. In another embodiment, a sample detonating cord was prepared by slipping a sheath of polyolefin heat-shrink tubing having a thickness of about 0.02 inch (about 0.5 mm) over a length of premanufactured, room-temperature detonating cord comprising an outermost jacket comprising a blend of about 80 percent LDPE low density polyethylene) and about 20 percent HDPE (high density polyethylene) having an outer diameter of about 0.130 inch (about 3.3 mm). The sheath was then heated sufficiently to shrink it onto the detonating cord. Alternatively (or, in addition) to cooling, the sacrificial extruded layer and the outermost interior jacket layer may comprise chemically incompatible or immiscible materials. Allowing for separation of an extruded jacket layer from one beneath it is contrary to standard practice in the art because it is normally desired that each successive extruded layer form a tight bond with the layer beneath it.

In other embodiments, the sacrificial jacket is made separable from the interior jacket by providing a sacrificial jacket comprising a sacrificial textile layer woven around the interior jacket and a sacrificial extruded layer thereon. Even if the sacrificial extruded layer bonds tightly to the sacrificial textile layer, the sacrificial textile layer will easily separate from the interior jacket layer around which it was woven. Therefore, when the sacrificial jacket functions, both the sacrificial extruded layer and the sacrificial textile layer separate from the interior jacket.

One embodiment of such a detonating cord is illustrated in schematic cross section in FIG. 1. Detonating cord 10 comprises a core 12 of explosive material enclosed in a composite jacket comprising an interior jacket 14 and a sacrificial jacket 20. Interior jacket 14 comprises a textile sleeve 16 and a surrounding extruded polymeric jacket layer 18. Optionally, core 12, sleeve 16 and jacket layer 18 may constitute a low-energy detonating cord, i.e., the interior jacket 14 may provide sufficient tensile strength, water-resistance, etc., to provide, without sacrificial jacket 20, a commercially acceptable detonating cord in accordance with the prior art. Adjacent to and surrounding the interior jacket 14 is the sacrificial jacket 20 disposed thereon in accordance with the present invention.

Core 12 may comprise any suitable explosive material; a typical core material comprises PETN. A detonating cord in accordance with this invention may have a core load of explosive material of less than about 3.2 grams/meter (g/m), optionally in the range of about 0.2 to 2 g/m (1 to 10 grains per linear foot (grains/ft)), optionally less than 1.25 g/m (6 grains/ft), e.g., from about 0.2 to 1.25 g/m (about 1 to 6 grains/ft). In one optional embodiment, the detonating cord may have a core loading of about 1 to 1.5 g/m (about 5 to 7 grains/ft).

Textile sleeve 16 may comprise any suitable textile suitable for maintaining the lengthwise continuity of core 12. Providing a textile sleeve around a core of explosive material for use in detonating cord is well-known in the art, as is the deposition of additional extruded and woven layers thereon, such as extruded interior jacket layer 18. Alternatively, the innermost jacket layer may be extruded over the core.

Interior jacket layer 18 surrounding textile sleeve 16 is the outermost layer of interior jacket 14. Interior jacket layer 18 may be a polymeric material extruded over textile sleeve 16. For example, jacket layer 18 may comprise a blend of about 80 percent LDPE (low density polyethylene) and about 20 percent HDPE (high density polyethylene), as is well-known in the art. In a particular embodiment, jacket layer 18 may have a thickness of about 0.5 millimeter (mm) (about 0.02 inch), which is slightly less than the thickness of an outer jacket layer in a corresponding prior art device, which has a thickness of about 0.75 mm (about 0.03 inch) but which lacks an outer sacrificial jacket.

The sacrificial jacket 20 comprises a sacrificial extruded layer extruded over jacket layer 18. Optionally, sacrificial jacket 20 may comprise a material that is chemically compatible or miscible with the material comprising jacket layer 18, e.g., sacrificial jacket 20 may comprise the same kind of polymeric material comprising the interior jacket layer on which it is disposed. For example, layer 18 and layer 20 may both comprise polyolefins, e.g., a mixture of 80% LDPE and 20% HDPE. To reduce the bonding that would otherwise occur between two extruded polymeric layers of like materials, interior jacket layer 18 is allowed to cool before sacrificial outer jacket 20 is extruded thereon so that the sacrificial jacket 20 does not meld into or strongly adhere to interior jacket layer 18. Cooling may be achieved by, e.g., passing the interior jacket through a cooling water bath before sacrificial jacket 20 is extruded thereon. The thickness of sacrificial jacket 20 is about 0.25 mm (0.01 inch), e.g., from about 0.125 mm to 0.36 mm (about 0.005 to 0.014 inch), optionally from about 0.2 to about 0.3 mm (about 0.008 to 0.012 inch). In particular embodiments, the total outside diameter of detonating cord 10 may be not greater than about 3.8 mm (0.15 inch), e.g., in the range of from about 3.3 to about 3.8 mm (about 0.13 to 0.15 inch), thus facilitating its use with a detonator having a standard size detonator shell, e.g., a No. 8 detonator shell having an inner diameter of about 6 millimeters (mm), e.g., 5.7 mm (about 0.22 inch).

Figure 2:
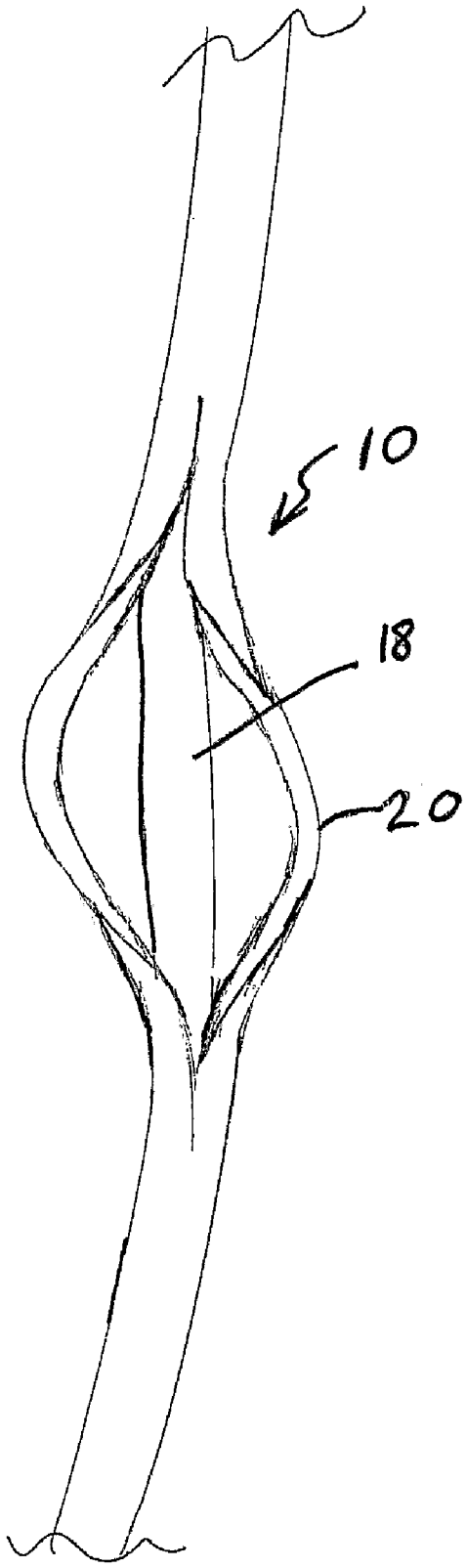
FIG. 2 is a schematic elevation view of the detonating cord of FIG. 1 after the functioning of an adjacent similar detonating cord.

In use, when a section of detonating cord 10 as shown in FIG. 1 is disposed adjacent to a similar section of detonating cord, e.g., in crosswise relation to each other, the sacrificial outer jacket of the cord of this invention will prevent cut-off of that section of cord should the other section of cord detonate. The mechanism by which the sacrificial outer jacket layer 20 functions is illustrated schematically in FIG. 2, where it is shown that at a point of contact, jacket layer 20 has fractured and has separated from the interior jacket layer 18, which remains intact.

In an alternative embodiment, jacket layer 18 may comprise a polymeric material that is incompatible with that of the sacrificial jacket layer in contact therewith, so that even if interior jacket layer 18 is not cooled before sacrificial jacket 20 is extruded onto it, jacket 20 will not strongly adhere to layer 18, although cooling may optionally be performed to enhance the separation of the sacrificial jacket from the interior jacket. In another embodiment, the sacrificial jacket could be made separable from the interior jacket by extruding the sacrificial jacket at a lower temperature than the interior jacket. The cooler temperature of the sacrificial jacket material inhibits intermingling of the polymeric materials of the sacrificial jacket and the interior jacket. For example, a detonating cord may comprise a core of explosive material surrounded by an outmost interior jacket comprising SURLYN™ polymer that may be extruded at 325° F. (about 163° C.) and a sacrificial jacket comprising polyethylene (e.g., a blend of about 80% LDPE and about 20% HDPE) that may be extruded over the SURLYN™ polymer at about 300° F. (about 150° C.).

In yet another embodiment, the sacrificial jacket is rendered separable form the interior jacket therein by using a sacrificial jacket material whose melting temperature and/or extrusion temperature are significantly lower than the corresponding temperature(s) of the interior jacket layer material. The sacrificial jacket layer may then be extruded at a cooler temperature than the extrusion temperature of the interior jacket layer, so that the cooler temperature of the sacrificial jacket layer material diminishes its tendency to blend with the jacket layer 18 on which it is disposed.

Figure 3:
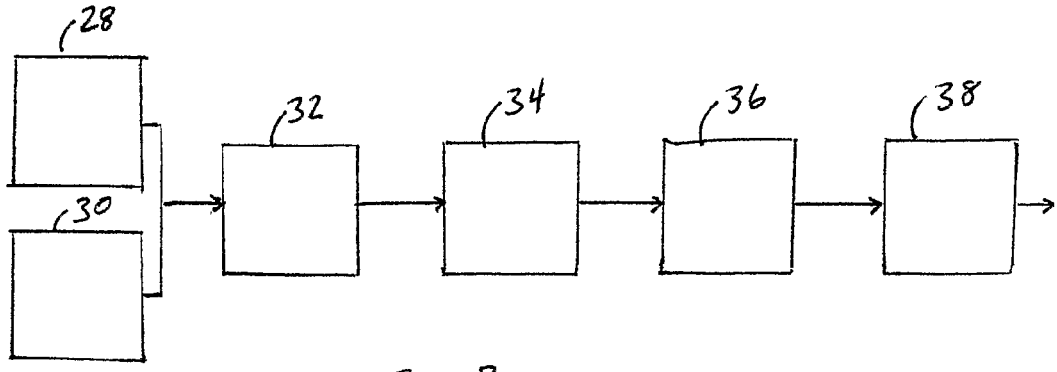
FIG. 3 is a flow chart that schematically illustrates one method for making detonating cord having a sacrificial jacket.

One specific embodiment of a method for producing detonating cord comprising a sacrificial jacket as shown in FIG. 1 is depicted schematically in FIG. 3. According to this method, a source of yarn 28 and a supply of pulverulent explosive 30 are provided to a first processing station 32 where the yarn is woven into a textile sleeve 16 (FIG. 1) about a core 12 of the explosive material. The resulting linear product is then passed to an extruder 34 (FIG. 3) where a polymeric jacket layer 18 (FIG. 1) is extruded over the textile sleeve 16, yielding a detonating cord comprising an interior jacket 14 (which comprises sleeve 16 and layer 18) disposed around a core 12. The detonating cord is then passed to an optional cooling station 36 (FIG. 3) which may comprise, e.g., a water bath, to cool layer 18 so that it resists adhesion by a subsequently extruded layer. The detonating cord then passes to an extruding station 38 where a sacrificial jacket 20 (FIG. 1) is applied over the interior jacket 14 to yield a detonating cord 10 according to one aspect of this invention.

Figure 4:
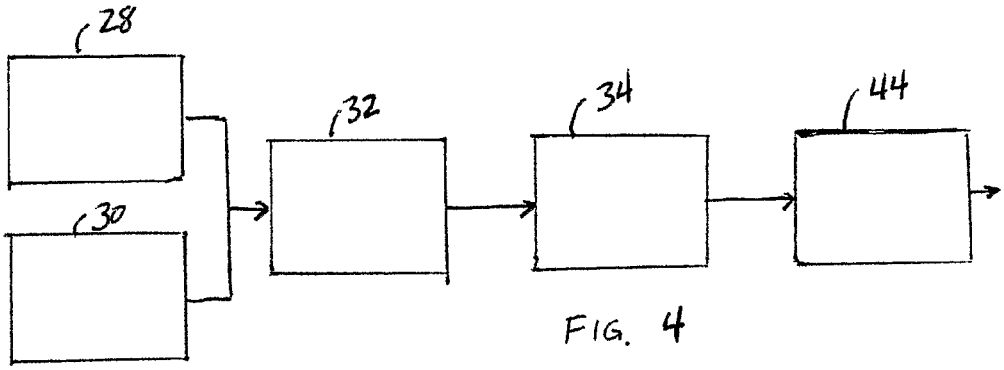
FIG. 4 is a flow chart that schematically illustrates another method for making detonating cord having a sacrificial jacket.

FIG. 4 depicts yet another embodiment of a method for producing detonating cord, in which yarn 28 and explosive material 30 are provided to first station 32, from which the linear product comprising a core 12 is encased in a textile sleeve 16 is passed to an extruder station 34. At extruder station 34, an interior jacket layer 18 is deposited the textile layer 16 to produce a detonating cord comprising the core of explosive material 12 and an interior jacket 14 (which comprises sleeve 16 and layer 18). The detonating cord then passes to an extrusion station 44 where a sacrificial outer layer 20 is deposited over the interior jacket to produce the detonating cord 10, without first being passed to a cooling station. In this embodiment, the sacrificial outer jacket 20 comprises a material that is incompatible with layer 18 and which is therefore easily separable therefrom.

Figure 5:
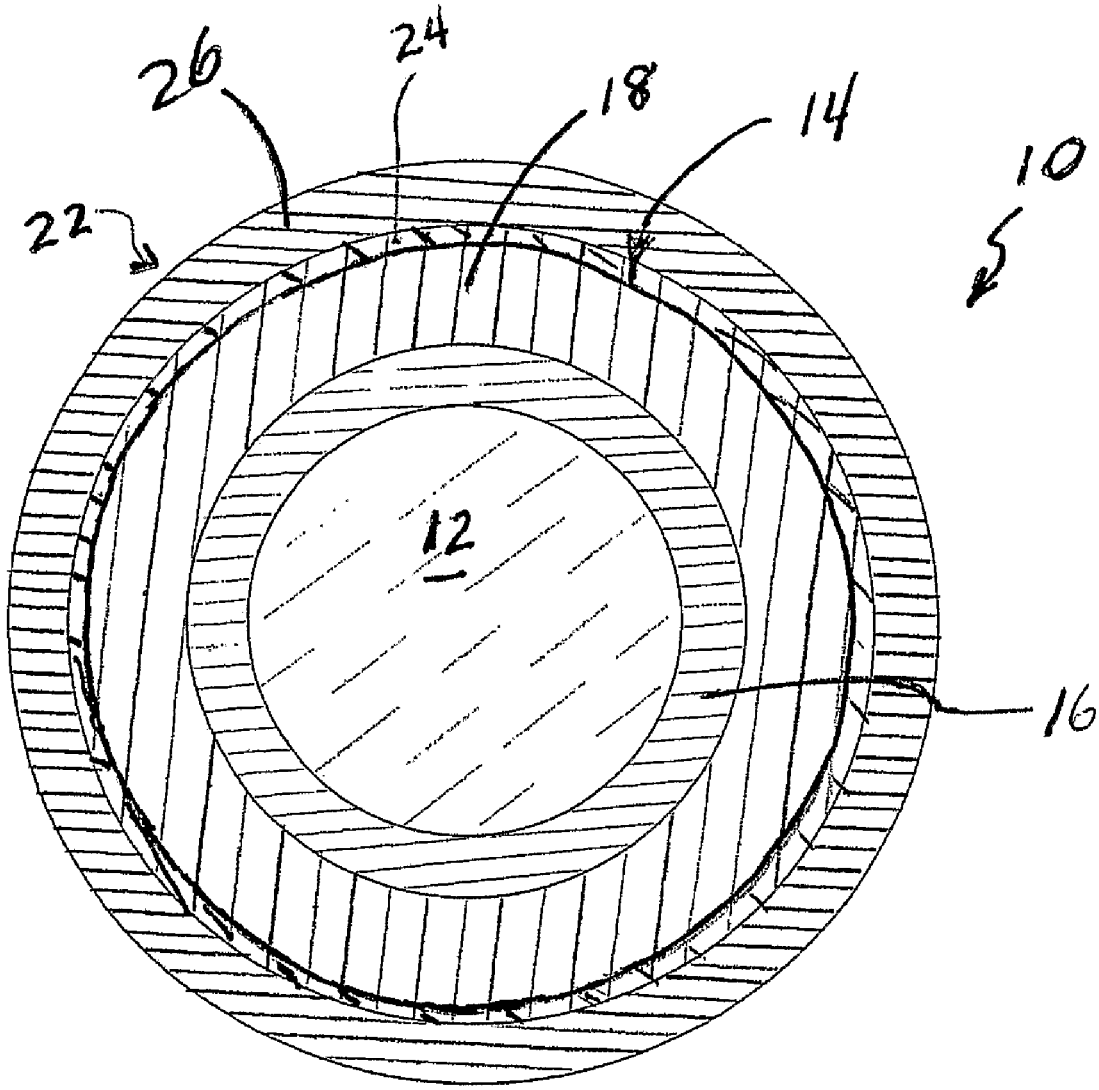
FIG. 5 is a schematic cross-sectional view of a detonating cord according to another embodiment of the invention.

An alternative embodiment of a detonating cord in accordance with this invention is shown in FIG. 5. Cord 10' comprises a core 12 of explosive material enclosed in a composite jacket comprising interior jacket 14 and a sacrificial jacket 22. Interior jacket 14 comprises a textile sleeve 16 and a surrounding extruded polymeric jacket layer 18. Sacrificial jacket 22 comprises a sacrificial textile layer 24 woven about interior jacket 14 and a sacrificial extruded layer 26 that has been extruded directly onto the sacrificial textile layer 24. The composite sacrificial jacket 22 is easily separable from interior jacket 14 by virtue of sacrificial textile layer 24. Detonating cord 10' functions in substantially the same way as detonating cord 10.

Figure 6:
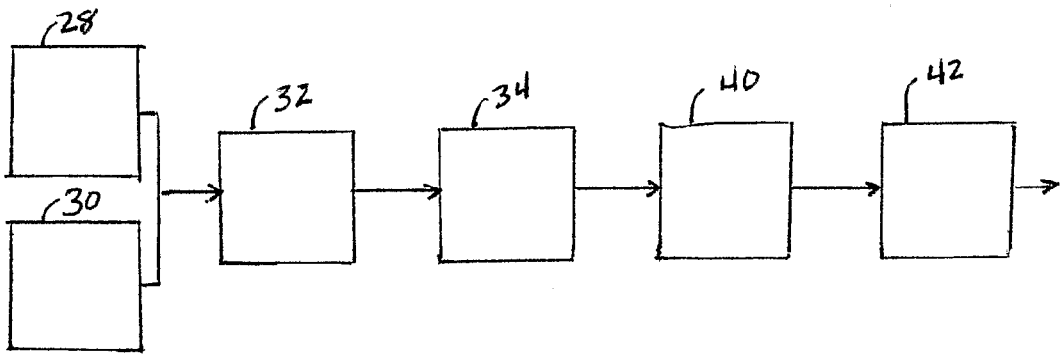
FIG. 6 is a flow chart that schematically illustrates another method for making detonating cord having a sacrificial jacket.

One embodiment of a method for making detonating cord 10' is depicted in FIG. 6, which illustrates that a source of yarn 28 and powdered explosive material 30 that are passed to a first station 32 as described with reference to FIG. 5 to yield a linear product comprising a textile sleeve 16 disposed over a core 12 of explosive material. The linear product is then passed to an extruding station 34 where an inner jacket layer 18 is applied to produce a detonating cord comprising an interior jacket 14 (comprising sleeve 16 and interior jacket layer 18) disposed over core 12. The detonating cord then passes to a third station 40 where a sacrificial textile jacket 24 is disposed over the interior jacket layer 18. The cord then passes to an extrusion station 42 where a sacrificial extruded layer 26 is extruded onto the sacrificial textile layer 24, to which it may adhere. Together, the sacrificial textile layer 24 and sacrificial extruded layer 26 comprise a sacrificial jacket 22. As described above, the sacrificial textile layer 24 is easily severable from the interior jacket 14 on which it is disposed, thus enabling the removal of the entire sacrificial jacket 22 from the detonating cord therein.

Figure 7:
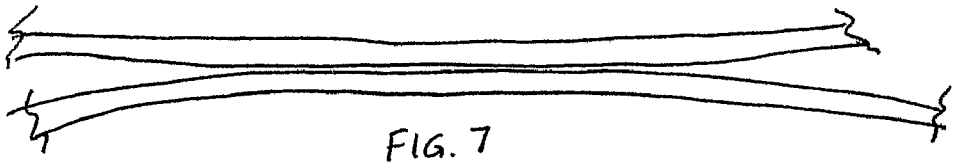
FIGS. 7, 8 and 9 are schematic plan views of detonating cords in adjacent relation to each other as described herein.
Figure 8:
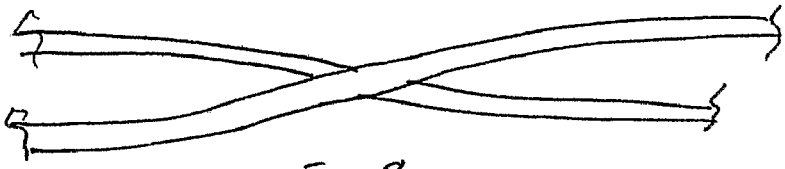
Figure 9:
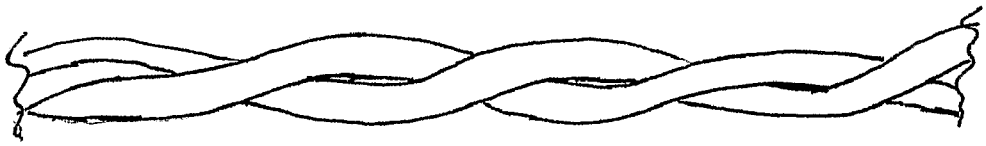

A section of a detonating cord comprising a sacrificial jacket as described herein may be disposed in adjacent relationship to a similar section of detonating cord and will survive the functioning of the adjacent section of detonating cord without experiencing cut-off. Such adjacent relationships include side-by-side, generally parallel relation, one embodiment of which being depicted, e.g., in FIG. 7; crosswise at an acute angle to each other, one embodiment of which being depicted in FIG. 8; or at right angles; and/or mutually twisted or intertwined dispositions, etc., as depicted, e.g., in FIG. 9, whether or not the two sections of cord in any of such adjacent relationships are in actual contact or are merely in close proximity to each other.

In other alternative embodiments, the interior jacket of a detonating cord may have a lesser or a greater number of layers than the interior jacket of the illustrated embodiments.

Although the invention has been illustrated and described with respect to a single embodiment thereof, it would be recognized by one of ordinary skill in the art, upon a reading and understanding of the foregoing, that numerous alterations and variations to the disclosed embodiment fall within the spirit of the invention and the scope of the following claims.

What is claimed is:

1. A detonating cord comprising:

a core of reactive material;

a composite jacket surrounding the core, the composite jacket having an interior jacket surrounding the core and in contact therewith, wherein the interior jacket comprises an outermost interior jacket layer; and a sacrificial jacket disposed over the interior jacket, wherein the sacrificial jacket is in direct, non-attached separable contact with the interior jacket, the sacrificial jacket being separable from the interior jacket in response to the detonation of an adjacent similar section of detonating cord and being effective to prevent the cord from being cut off by the adjacent similar section of detonating cord.

2. The detonating cord of claim 1 having a core load of less than about 3.2 grams/meter (g/m) (15 grains/ft).

3. The detonating cord of claim 2 having a core load of less than 1.25 g/m (6 grains/ft).

4. The detonating cord of claim 2 having a core load in the range of about 0.2 to about 2 g/m (1 to 10 grains/ft).

5. The detonating cord of claim 4 having a core load in the range of from about 1 to about 1.5 g/m (5 to 7 grains/ft).

6. The detonating cord of claim 1, claim 2 or claim 4 wherein the outer cross-sectional diameter of the cord is not more than about 3.8 mm (0.15 inch).

7. The detonating cord of claim 1 or claim 2 wherein the interior jacket is free of metal jacket layers.

8. The detonating cord of claim 1, claim 2 or claim 4 wherein the sacrificial jacket comprises a sacrificial extruded layer disposed directly onto the interior jacket.

9. The detonating cord of claim 8 wherein the sacrificial extruded layer comprises a layer of polyethylene having a thickness of about 0.25 mm (0.01 inch).

10. The detonating cord of claim 8 wherein the outermost interior jacket layer and the sacrificial jacket comprise mutually compatible polymeric materials.

11. The detonating cord of claim 10 wherein the sacrificial extruded layer and the outermost interior jacket layer both comprise polyethylene and the thickness of the sacrificial extruded layer has a thickness of about 0.25 mm (0.01 inch).

12. The detonating cord of claim 8 wherein the outermost interior jacket layer and the sacrificial jacket comprise mutually incompatible polymeric materials.

13. A method for making a detonating cord, comprising:

disposing an interior jacket around a core of explosive material, the interior jacket having at least an outermost interior jacket layer, the interior jacket being insufficient to protect the detonating cord against cut-off by the initiation of an adjacent similar section of detonating cord; and disposing a sacrificial jacket over the interior jacket and in direct, non-attached separable contact with the interior jacket, the sacrificial jacket being separable from the interior jacket in response to the detonation of an adjacent similar section of detonating cord and being effective to prevent the cord from being cut off by the adjacent similar section of detonating cord.

14. The method of claim 13 comprising extruding the sacrificial jacket onto the interior jacket, wherein the sacrificial jacket and the outermost interior jacket layer comprise polymeric materials that are mutually compatible, and wherein the method comprises cooling the interior jacket before extruding the sacrificial jacket onto it.

15. The method of claim 13 comprising extruding the sacrificial jacket onto the interior jacket, wherein the sacrificial jacket and the outermost interior jacket layer comprise mutually incompatible polymeric materials.

* * * * *